United States Patent [19]

McCrory

[11] Patent Number: 4,968,541

[45] Date of Patent: Nov. 6, 1990

[54] ARTIFICIAL TREE

[76] Inventor: Vernon D. McCrory, P.O. Box 390, Waynesboro, Tenn. 38485

[21] Appl. No.: 431,894

[22] Filed: Nov. 6, 1989

[51] Int. Cl.[5] ..... A47G 33/06

[52] U.S. Cl. ..... 428/9; D11/118; 211/196; 362/123; 428/20; 428/27

[58] Field of Search ..... D11/118; 211/196; 362/123; 428/9, 18, 19, 20+27

[56] References Cited

U.S. PATENT DOCUMENTS

| | | | |
|---|---|---|---|
| D. 269,771 | 7/1983 | Williams | D11/118 |
| D. 276,322 | 11/1984 | Maxwell et al. | D11/118 |
| 2,731,752 | 1/1956 | Erickson et al. | 428/18 X |
| 3,674,612 | 7/1972 | Gehl, Jr. | 428/19 X |
| 3,677,867 | 7/1972 | Westlund | 428/20 X |
| 3,704,366 | 11/1972 | Korb et al. | 428/18 X |
| 3,723,723 | 3/1973 | Lerner | 428/18 X |
| 3,967,019 | 6/1976 | Magee | 428/18 X |
| 4,130,678 | 12/1978 | Higgins | 428/20 X |
| 4,331,720 | 5/1982 | Vin Dick et al. | 428/20 X |
| 4,746,022 | 5/1988 | Benham | 428/20 X |
| 4,748,058 | 5/1988 | Craig, Jr. | 428/18 X |

*Primary Examiner*—Henry F. Epstein
*Attorney, Agent, or Firm*—John C. Garvin, Jr.

[57] ABSTRACT

An artificial Christmas tree adapted to hang from a support structure such as a hook attached to the ceiling of a room or a center post during the Christmas season and to be quickly and easily collapsed and placed in a box, while still decorated with ornamentations such as colored balls, electrical lights and garland, for storage purposes, during the non-Christmas seasons. The collapsible artificial tree comprises a plurality of circular, concentric, limb sections connected together through flexible suspension means, each limb section being assembled in spaced-apart relationship and being of different external diameters. When assembled concentrically through use of the flexible suspension means, the limb sections gradually increase in diameter along an axis common to all of the limb sections with the limb section having the largest diameter being at the bottom of the tree and the limb section having the smallest diameter being near the top of the tree when the tree is suspended in its display position. This arrangement provides the tapering effect generally exhibited by trees of the fir, pine and spruce families. The height of the tree is determined by the number of limb sections making up the tree. The height of the tree can be readily adjusted by adding or removing limb sections.

15 Claims, 4 Drawing Sheets

ARTIFICIAL TREE

TECHNICAL FIELD

This invention relates to an artificial tree, and more particularly to an artificial Christmas tree adapted to hang from a support structure such as a hook attached to the ceiling of a room or a center post during the Christmas season and to readily collapse, while still decorated, for storage purposes during the non-Christmas season. When the next Christmas season arrives, the tree is removed from its storage box by grasping a hook attached to the tree to raise the tree out of the storage box toward the support structure which may be another hook anchored in the ceiling of the room. During the process of moving the hook of the tree from the storage box and raising it toward the support structure, the tree unfolds and takes the shape of a Christmas tree of the fir, pine or similar species.

BACKGROUND OF THE INVENTION

Artificial Christmas trees are quite common and many different approaches have been used in constructing such trees. A number of patents have been granted on artificial trees and these include: U.S. Pat. Nos. 2,731,752 (Erickson et al); 3,677,867 (Westlund); 4,130,678 (Higgins); 4,331,720 (Vin Dick et al); 3,674,612 (Gehl, Jr.); 4,748,058 (Craig, Jr.); and 4,746,022 (Benham).

The Erickson et al patent discloses a collapsible artificial tree having a plurality of loops supported in spaced apart relation by a plurality of flexible stringers extending over a hook which supports the tree from the ceiling of a room. The loops are covered with a translucent wrapping cloth which glows when light from an external light source is directed upon the wrapping cloth. The Westlund patent discloses a collapsible artificial tree for suspension from a ceiling in one embodiment which is stored in a relatively flat box. The tree is formed by a continuous spring-like, conically shaped, spiral frame member having electrical conductor means and ornamentation means attached thereto. The frame member includes a plurality of convolutions adapted to be concentrically collapsed into a generally flat spiral configuration for storage purposes. The Higgins patent discloses a collapsible artificial tree having a telescopic mast mounted on a base and a garland extending from the base and the top of the mast to form a generally conically-shaped configuration when in an erected position.

The Vin Dick et al patent discloses a collapsible artificial tree which folds away into a box which also serves as a stand for the mast of the tree when erected. The tree includes a generally spiral coil of wire coated with artificial pine covering capable of supporting tree lights. The Gehl Jr. patent discloses a folding tree-like display stand including a plurality of axially aligned rings or disks of graduated diameters mounted vertically to form a generally conical shape. In one embodiment, the rings or disks are interconnected by a plurality of cords and are supported by a mast, a conical top member and a base. This tree-like stand is for displaying ornamental objects in such a manner that they can be easily installed, removed or replaced. The Craig, Jr. patent discloses an artificial tree including a base, a center pole, and a plurality of radially extending limb sections of varying sizes slideable upon the center pole and being interconnected by plurality of garlands which may be of many colors or have lights incorporated therein. The tree is also adapted to suspend from a ceiling in lieu of being supported by a center pole. The Benham patent discloses a collapsible support structure which may be either free standing or adapted to hang from an overhead support. The structure includes a plurality of concentric rings mounted on a center post and interconnected by straps. The structure may be used as an ornament or ornament support as well as general utility as a support rack.

The prior art artificial Christmas trees, including the collapsible trees discussed above, have been relatively incomplete and have required considerable effort to be decorated in order to ready such trees for display after they have been extended from a collapsed condition. The prior art artificial trees were not adaptable for adding or removing limb sections to increase or decrease the height of the tree.

Accordingly, it is an object of the present invention to provide a decorated collapsible Christmas tree which is quick and easy to be erected for display purposes or folded up into a relatively thin box for storage purposes.

It is a further object of the present invention to provide a collapsible Christmas tree which is very compact for storage and very attractive when in a erected or display position and includes permanently attached ornamentations and electrical lights.

It is still a further object of the present invention to provide a collapsible Christmas tree which is readily adaptable for adding or removing limb sections to increase or decrease the height of the tree.

These objects as well as other objects of the present invention will become more readily apparent after reading the following description in conjunction with the accompanying drawings.

SUMMARY OF THE INVENTION

In accordance with the present invention, an artificial Christmas tree is provided which pulls up to a full tree, already decorated, from a generally flat storage box having a depth substantially less than the height of the tree when in its extended or display position. The tree is adapted to hang from an overhead structure, such as a hook in the ceiling of a room or a center post, during the Christmas season and to readily collapse, while still decorated, for storage in the box for the remainder of the year.

The tree is comprised of a plurality of circular limb supporting sections or rings connected together through a series of stringers, each limb supporting section being assembled in spaced-apart relationship and being of a different external diameter. When assembled concentrically through use of the stringers, the limb supporting sections gradually increase in diameter along an axis common to all of the limb supporting sections with the limb supporting section of the largest diameter being at the bottom of the tree and the limb section of the smallest diameter being near the top of the tree when the tree is suspended from an overhead structure. This arrangement provides the tapering effect generally exhibited by trees of the fir and pine families. Each limb supporting section has a plurality of artificial limbs or branches or garlands attached thereto with each larger limb supporting section section having more limbs, branches or garlands attached thereto than a smaller limb supporting section. The height of the tree is determined by the number of limb supporting sections making up the tree. The height of the tree can be readily adjusted by adding or removing limb supporting sections from the tree.

DESCRIPTION OF THE PREFERRED EMBODIMENT

Figure 1:
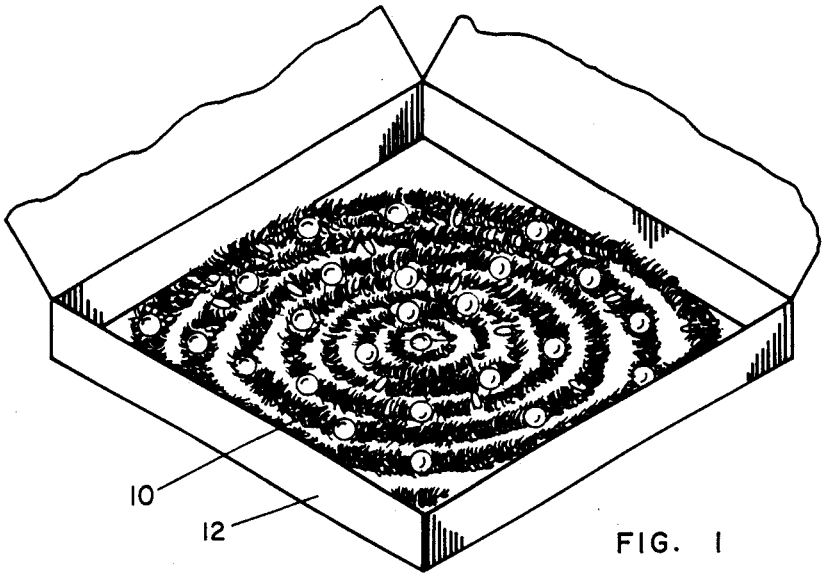
FIG. 1 is a perspective view of the Christmas tree of the present invention as shown in its collapsed condition in a box ready for storage.

As shown in FIG. 1 of the drawings, the collapsible Christmas tree 10 of the present invention may be stored in a box or other suitable container 12, wherein each discrete circular, concentric, limb section of the tree nests within a larger limb supporting section for storage purposes. A six foot tree is capable of collapsing to a height of four to twelve inches depending upon the amount of decorations carried by the tree.

Figure 2:
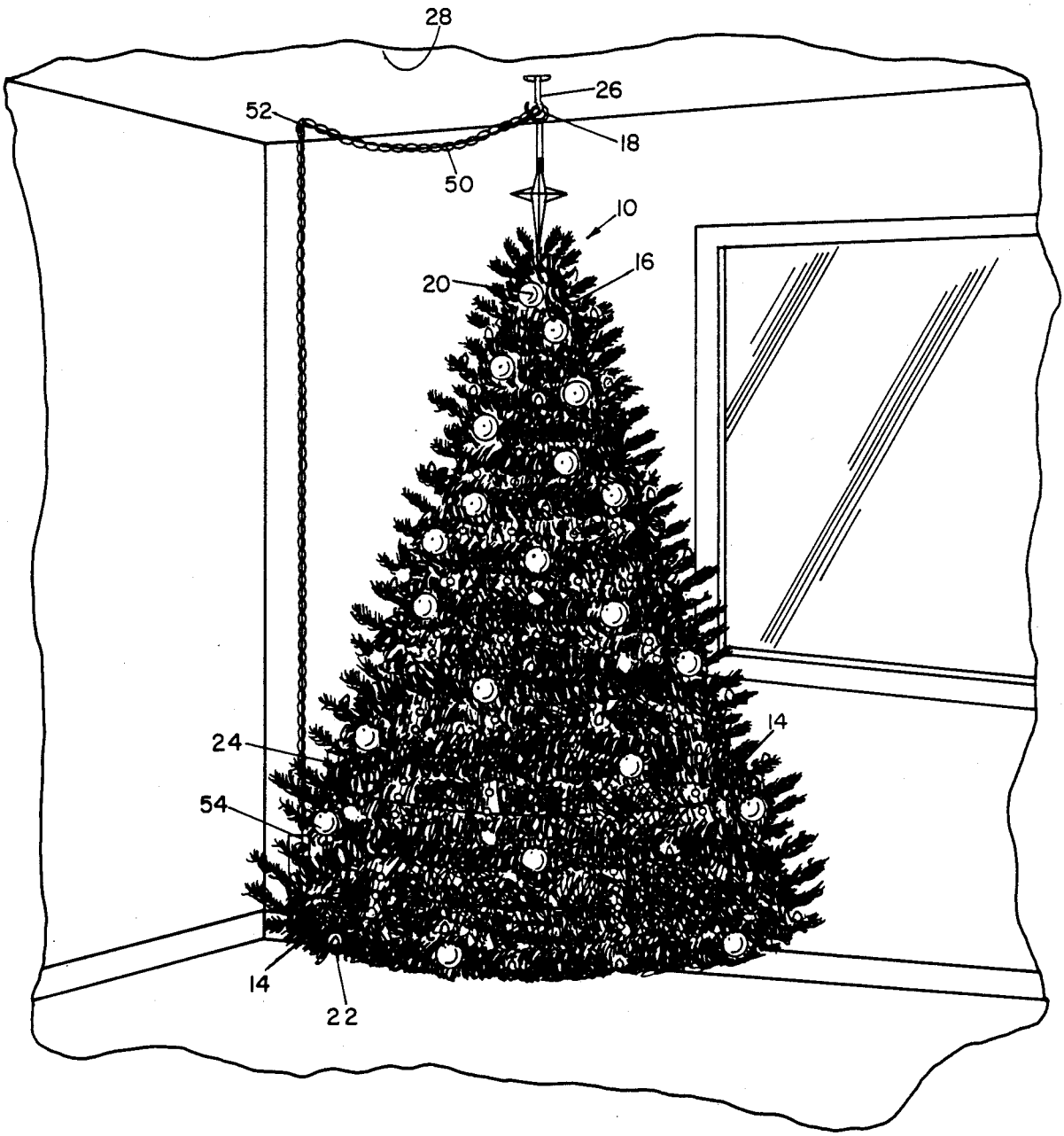
FIG. 2 is a pictorial view of the artificial Christmas tree of the present invention in the erected position suspended from the ceiling of a room.
Figure 3:
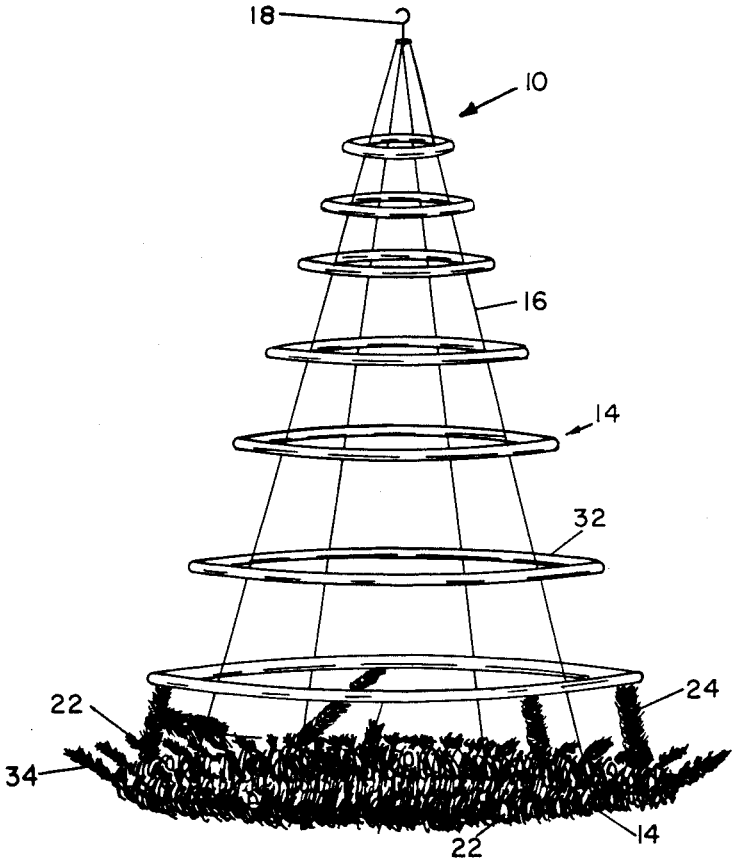
FIG. 3 is a perspective view of the artificial tree of the present invention showing the general arrangement of the plurality of hoops and stringers with only the bottom hoop bearing branches.

Referring to FIGS. 2 and 3, the basic components of tree 10 include a plurality of circular limb supporting sections 14 of graduated diameters, a plurality of elongated flexible stringers 16 for interconnecting the limb sections 14, a suspension element 18 attached to one end of elongated flexible stringers 16, and ornamentations such as balls 20, electrical lights 22, and garland 24. The tree, in its display position, is adapted to be suspended by suspension element 18 from an overhead structure such as hook 26 attached to the ceiling 28 of a room. The tree 10, in its display position, is also adapted for suspension from a post 30 (see FIG. 6) connected to a suspension element placed within the center of the tree. FIG. 2 shows a tree having a definite number of limb supporting sections 14 and flexible stringers 16; it being understood that the tree of the present invention could include almost any number of such limb supporting sections and flexible stringers depending upon the height of the tree.

Each limb supporting section 14 is fabricated from a circular hoop or ring 32 having a plurality of limbs or branches 34 secured thereto. Each circular hoop 32 may be hollow or solid and be made of any suitable material such as plastic or light metal. Branches or limbs 34 may be made of any suitable material such as plastic or garland rope which are secured, by friction fit, to hoops 32 by being inserted into openings 36 spaced within hoops 32. As an alternative, limbs or branches 34 may be attached to hoops 32 in spaced-apart relationship by any other suitable means such as glue or being fused thereto. The hoops 32 of limb supporting sections 14 are arranged such that the largest hoop is the lowermost of the hoops and the smallest hoop is the uppermost hoop with each intervening hoop being of slightly smaller diameter from the largest hoop to the smallest hoop.

Figure 6:
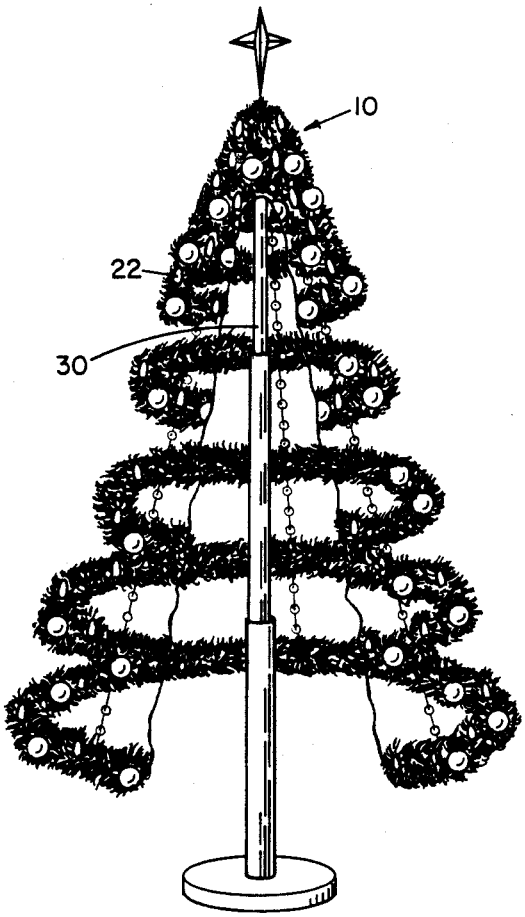
FIG. 6 is a partially broken away perspective view of the Christmas tree of the present invention showing the tree being supported by a telescopic center post.
Figure 7:
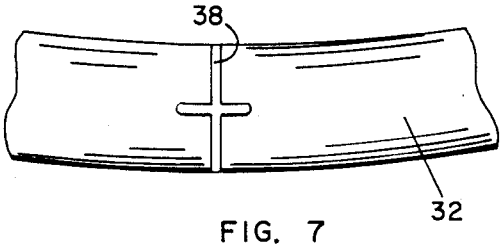
FIG. 7 is an enlarged view of a notch cut in the hoop depicting one way of attaching the stringers to the hoops.
Figure 8:
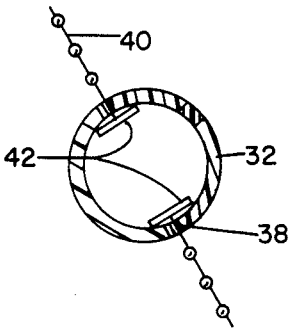
FIG. 8 is a cross sectional view depicting the manner of attaching the stringers to the hoop when utilizing the notches in the hoops as depicted in FIG. 7.
Figure 9:
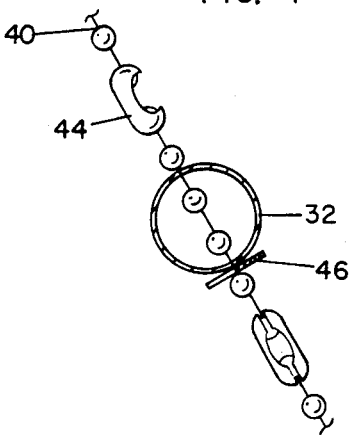
FIG. 9 is a cross sectional view showing another way of attaching the hoops of the Christmas tree of the present invention to the stringers.
Figure 4:
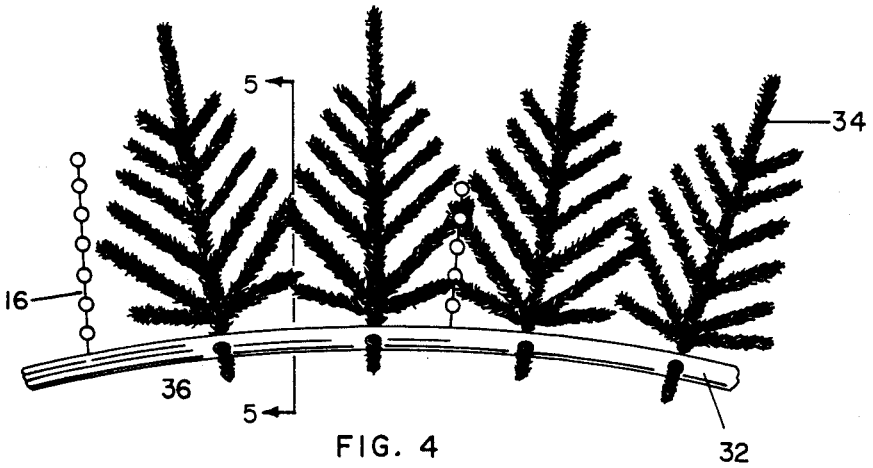
FIG. 4 is a perspective view showing a hoop and one way of attaching the branches thereto.
Figure 5:
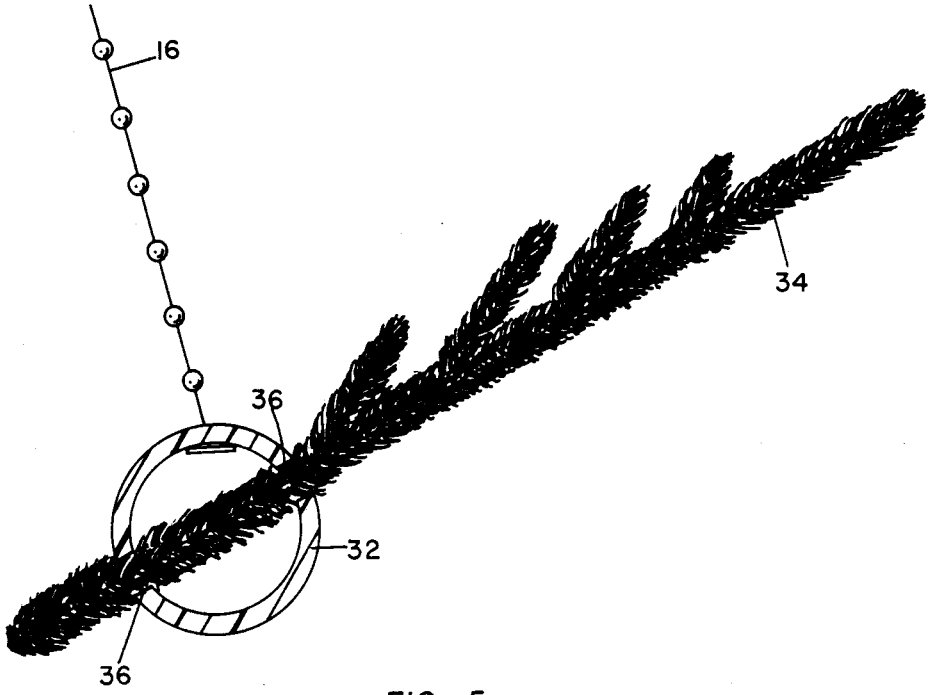
FIG. 5 is an enlarged sectional view taken along line 5—5 of FIG. 4 showing one way of attaching the branches to the hoops.

As shown in FIGS. 2, 3 and 6, hoops 32 are interconnected in spaced-apart relationship by a plurality of flexible stringers 16 attached to the hoops 32 and being made from any suitable material such as chain, rope or ribbon. Stringers 16 are shown in FIGS. 2, 3 and 6 as being of one piece and extending from the largest of the hoops to the suspension element 18 attached at the upper end of each stringer 16. However, it is to be understood that the stringers 16 could be a series of short pieces connected to adjacent hoops 32 in manners as shown in FIGS. 8 and 9. The stringers are attached to the hoop by any suitable means such as notches, adhesives or connectors or a combination thereof. FIG. 7 depicts one embodiment of a series of notches 38 cut in hoops 32 for attaching a series of chain stringers 40. Each of FIGS. 8 and 9 depicts a manner of attaching the series of chain stringers 40 to hoops 32 using notches 38. FIG. 8 shows two buttons 42 attached to the end of chain stringers 40 which are readily inserted into notches 38 for securing the hoops 32 to chain stringers 40. FIG. 9 shows the use of conventional chain connectors 44 and a clip 46 for securing hoops 32 to chain stringers 40. As is readily apparent, the use of a series of chain stringers such as those bearing reference numeral 40, one or more of the lowest of limb sections 14 can be readily and easily added or removed from tree 10 to adjust the height of the tree.

Ornamentations, such as colored balls 20, electrical lights 22, and garland 24 are used for decorating the tree 10. The ornamentations are arranged and attached to either the limb supporting sections 14 or the stringers 16 by conventional means such as hooks or strings or mere gravity much like is done on an ordinary Christmas tree. Garland 24 can be wrapped upon tree 10 parallel to, perpendicular to or diagonal to hoops 32 as partially shown in FIG. 3. After the first decoration of the tree during the assembly thereof, the tree of this invention never requires further decoration. At most, when first erected each Christmas season, the ornamentations might require very minor adjustment.

As shown in FIG. 2, a swag chain 50 is supported in looped disposition by a hanger 52 secured to the ceiling of the room and the swag chain 50 carries a conventional electrical conductor which may be plugged into the conventional electrical outlet 54. The electrical conductor carried by swag chain 50 may be electrically connected to conventional electrical conductor means connected to electrical lights 22 attached to limb sections 14 or stringers 16. While swag chain 50 supports a conventional electrical conductor, it will be obvious that an electrical conductor extending to tree 10 directly from outlet 54 could be employed without the need for swag chain 50.

In operation, the entire collapsible Christmas tree 10 as hereinabove described may be stored with all of its ornamentations and electrical equipment in the box 12, as shown in FIG. 1, and may be readily extended to its display or erected position, as shown in FIGS. 2 and 6, by grasping the suspension element 18 and raising it toward support structure 26 or 30, and such may be quickly accomplished since the flexible stringers 16 accurately space and suspend the concentric limb supporting sections 14 in vertically spaced relationship to each other to provide the tapered appearance of a live Christmas tree. Since limb supporting sections 14 already support ornamentations and electrical equipment, a person need only to attach the suspension element to the support structure and the Christmas tree is ready for display as shown in FIGS. 2 and 6.

Although I have shown a specific construction and arrangement of the parts and features constituting a preferred embodiment of my invention, changes may be made in the parts and features without affecting the operativeness of the invention. For example, it is readily apparent that a one-piece netting, shaped like a teepee, could be readily substituted for flexible stringers 16 for holding hoops 32 in spaced relationship to each other when tree 10 is in its display position. It will therefore be obvious to those skilled in the art that various modifications may be made without departing from the spirit of the invention. Having fully described my invention and the presently preferred embodiment thereof,

I claim:

1. An artificial tree adapted to be suspended from a support structure, said tree comprising:

a. a suspension element;

b. a plurality of elongated flexible members; and c. a plurality of discrete, circular, limb supporting sections of graduated diameter, each said limb supporting sections having support means disposed for supporting a plurality of tree limbs or branches peripherally therearound, and, each said circular limb supporting section of a larger diameter being releasably connected to one of said circular limb supporting sections of a smaller diameter by said elongated flexible members, the smallest of said circular limb supporting sections being connected to said suspension element by said elongated flexible members, said elongated flexible members serving as the sole support for each of said circular limb support sections responsive to said tree being suspended from said support structure;

d. said circular limb supporting sections being adapted to telescopically move between a collapsed storage position where each smaller diameter limb supporting section generally nests within each larger diameter limb supporting section to an extended display position where said circular limb supporting sections separate and suspend from one another and said suspension element and said support structure in spaced-apart relationship;

e. said diameters of said circular limb supporting sections being such that said circular limb supporting sections provide the tapered shape of a tree when in said display position.

2. The artificial tree of claim 1 wherein said suspension element comprises a hook attached to said elongated flexible members and being adapted to be attached to said support structure when said tree is in its extended display position.

3. The artificial tree of claim 2 wherein each of said elongated flexible members is a small, continuous, filament attached to each of said circular limb sections and said suspension element.

4. The artificial tree of claim 2 wherein each of said circular limb supporting sections comprises a hollow cylindrical hoop having a plurality of equally spaced transverse grooves therein, and a plurality of branches attached thereto, each of said elongated flexible members comprising a plurality of small discontinuous chains passing through said grooves for attachment to one of said hoops, each of said chains including a connector on one end thereof for connecting to the opposed end of an adjacent chain leading to the next larger diameter hoop to enable a separation or connection of chains to readily adjust the height of the tree.

5. The artificial tree of claim 2 wherein each of said circular limb supporting sections comprises a hollow cylindrical hoop having a plurality of equally spaced transverse grooves therein, and a plurality of branches attached thereto, each of said elongated flexible members comprising a plurality of small discontinuous chains having a button secured to each end thereof which passes through said grooves for engaging the wall of the groove for attaching each of said chains to two of said hoops to enable a separation or connection of chains to readily adjust the height of the tree.

6. The artificial tree of claim 3 wherein said circular limb supporting sections comprise a hollow cylindrical hoop and a plurality of limbs or branches attached to said hoops, said limbs or branches extending from said hoops in a generally upward direction.

7. The artificial tree of claim 6 wherein said tree is a Christmas tree and wherein ornamentation means are attached to said hoops and branches.

8. The artificial Christmas tree of claim 7 wherein said ornamentation means comprises ball-shaped elements, electrical lights, and garland.

9. The artificial tree of claim 8 wherein said hoops have a series of small opening therein for receiving said limbs or branches for attaching said limbs or branches to said hoops.

10. The artificial tree of claim 8 wherein glue is used for attaching said branches to said hoops.

11. The artificial tree of claim 8 wherein said limbs or branches are fused to said hoops.

12. In a collapsible Christmas tree, the combination of:

a. a conically shaped frame comprised of a plurality of discrete, concentric, limb supporting sections of graduated diameters each said limb supporting sections having support means disposed for supporting a plurality of tree branches peripherally therearound, and, said frame adapted to be collapsed into a generally flat telescopic configuration, said conically shaped frame including a suspension element at a central apex portion thereof;

b. ceiling fixture means coupled to said suspension element of said conically shaped frame;

c. flexible suspension means connected to said limb supporting sections of said frame for holding said limb supporting sections in a vertical spaced relationship in a conically shaped configuration, said flexible suspension means serving as a sole support for each of said circular limb support sections responsive to said frame being suspended from said suspension means; and d. ornamentation means including ball shaped elements, electrical lights, and garland attached to and wrapped around said conically shaped frame and said flexible suspension means, whereby said collapsible Christmas tree comprises permanently attached electrical lights and other ornamentations and may be displayed during the Christmas season in a conically shaped configuration or may be readily stored complete with electrical lights and other ornamentations in a generally flat telescopic configuration during non-Christmas season pending subsequent seasonal display.

13. The combination as claimed in claim 12 wherein each of said discrete, concentric, limb supporting sections comprises a hollow cylindrical hoop and a plurality of limbs or branches attached to each of said hoops, said limbs or branches extending from said hoops in a generally upward direction.

14. The combination as claimed in claim 13 wherein said flexible suspension means comprises a plurality of small, continuous, filaments connected to each of said limb supporting sections and said suspension element.

15. The combination of claim 13 wherein said flexible suspension means comprises a plurality of small chains, each having opposed ends including means thereon adapted to be detachably connected to adjacent limb sections to enable a separation or connection of said chains to readily adjust the height of the tree.

* * * * *